United States Patent [19]

Schneider et al.

[11] Patent Number: 4,548,677

[45] Date of Patent: Oct. 22, 1985

[54] CIGARETTE PAPER

[75] Inventors: Werner Schneider, Quickborn; Dirk Pangritz, Wedel; Walter Riedesser, Neustadt, all of Fed. Rep. of Germany

[73] Assignee: B.A.T. Cigaretten-Fabriken GmbH, Hamburg, Fed. Rep. of Germany

[21] Appl. No.: 547,196

[22] Filed: Oct. 31, 1983

[30] Foreign Application Priority Data

Oct. 30, 1982 [DE] Fed. Rep. of Germany ..... 3240253

[51] Int. Cl.[4] ..... D21F 11/00

[52] U.S. Cl. ..... 162/139; 131/358; 131/365; 162/149

[58] Field of Search ..... 162/139, 149, 181.1; 131/358, 365

[56] References Cited

U.S. PATENT DOCUMENTS 3,908,671 9/1975 Cogbill ..... 162/139

FOREIGN PATENT DOCUMENTS 1106695 3/1968 United Kingdom ..... 162/139

*Primary Examiner*—Peter Chin

*Attorney, Agent, or Firm*—Armstrong, Nikaido, Marmelstein & Kubovcik

[57] ABSTRACT

The invention relates to a cigarette paper having the conventional burning additives and fillers containing from 20 to 50% by weight of bast fibres of fine fibrillation, with which a degree of grinding of at least 85 SR is produced. The cigarette paper produced according to this formulation has a pore structure which greatly promotes diffusion, in particular diffusion of carbon monoxide.

4 Claims, No Drawings

CIGARETTE PAPER

This invention relates to a cigarette paper comprising fibrous materials based on rag fibres, burning additives and fillers.

Cigarette smoke which is produced when a cigarette is smoked is an aerosol, and thus it consists of a gas phase and a particle phase. Whereas the particle phase substantially determines the taste of the cigarette smoke, i.e. it is essential to the enjoyment of smoking, the gas phase is undesired, in particular because of its content of carbon monoxide. However, a reduction of the gas phase, for example by intentionally changing the properties of the cigarette paper, has hitherto always resulted in a reduction of the particle phase, and thus has resulted in the taste of the cigarette being influenced. An increase in the air-permeability of the cigarette paper or the use of burning additives are mentioned as examples of such intentional changes in the properties of the cigarette paper which are associated with influencing the taste of the cigarette.

Since the cigarette papers which are usually used have a porous structure, during the draw phase air flows through the cigarette paper into the inside of the cigarette, thereby causing a dilution of the cigarette smoke and thus a reduction of the smoke concentration. At the same time, the gas phase is reduced in that the gas molecules diffuse outwards through the cigarette paper.

An approximate relationship exists between the air-permeability and the diffusion coefficient for standard cigarette papers, in that the square of the diffusion coefficient is proportional to the air-permeability (Beiträge zur Tabakforschung, Volume 9, Part 3, October 1977, P. 131 et seq).

An object of the present invention is to provide a cigarette paper of the specified type which allows the diffusion of greater quantities of carbon monoxide out of the cigarette, without appreciably influencing the particle phase.

According to the present invention there is provided a cigarette paper comprising: fibrous materials based on rag fibres; burning additives and fillers; and wherein the paper comprises from 20 to 50% by weight of rag fibres and/or regenerated cellulose fibres, based on the dry weight of the paper, with an extremely fine fibrillation, with which a degree of grinding of the rag fibres and/or of the regenerated cellulose fibres of at least 85 SR is produced.

Preferably, the degree of grinding is at least 92 SR.

In an advantageous embodiment, the rag fibres are bast fibres of annual plants, preferably of flax, hemp, ramie, cotton, jute or cotton linters.

Preferably, the fibre fraction R16 (as herein later defined) ranges from 25 to 60%, preferably from 35 to 45%, of the initial charging mass.

Preferably, the area weight of the cigarette paper is from 16 to 40 g/m$^2$, preferably from 20 to 30 g/m$^2$.

Each fibrous material has particular properties with respect to the constitution of the cigarette paper. The advantages which are achieved by the present invention are based on the one hand on a comparatively high proportion of bast fibres and/or regeneraged cellulose fibres, in particular the bast fibres of so-called annual plants, since systematic research has shown that these types of fibre have particular properties in terms of fibre morphology which considerably influence the diffusion of carbon monoxide.

Moreover, the pliability of these fibres during the grinding process, which conclusively determines the later structural formation of the cigarette paper, is used for good fibrillation, i.e. for an optimum loosening into the fine individual fibres. A degree of grinding of at least 85 SR, in particular 92 SR, must be observed to this end.

The fibrillation is detected by a subjective microscopic assessment using comparative preparations. In terms of measurement technology, this assessment is supported by suitable measurement processes which function on the basis of dehydration behaviour, for example the degree of grinding SR.

This extremely fine fibrillation increases the active surface, because the individual fibres lie closer together and mutual entangling is promoted. Consequently, a larger number of smaller pores results, as a result of which the diffusion coefficient of the relatively small carbon monoxide molecules is increased, whereas the diffusion coefficients of the other consitituents of the gas phase are not appreciably influenced.

Experiments have shown that the structure of the cigarette paper, in particular the above-mentioned pore structure, more strongly influences the carbon monoxide reduction in the case of cigarettes having filter ventilation than the case of cigarettes without filter ventilation.

The content of from 20 to 50% by weight of bast fibres is associated with an air-permeability of up to 100 cm$^3$/min. cm$^2$. k Pa, the diffusion coefficient increasing as the content of bast fibres increases, as established by experiments. This fact is significant in a technological sense as well as in an economic sense.

In order to ensure the pore structure, the fine sheet texture and the corresponding pore volume, a certain length ratio of the ground bast fibres should, moreover, be observed. The fibre length ratio is established by determining the so-called "fibre fraction $R_{16}$" as the residue on a sieve having 16 meshes per 1 cm, under stipulated experimental conditions. In the case of the cigarette paper according to the present invention, the fibre residue should range from 25 to 60%, preferably from 35 to 45%, of the initial charging mass which adds up to 100%, in order to achieve the desired pore structure.

As will be verified by results of experiments (see later), the carbon monoxide content in the main smoke of the cigarette may be influenced by the parameters which have been stated, that is the carbon monoxide content may be reduced due to the improvement of the diffusion of the carbon monoxide out of the cigarette, while the air-permeability and other constant properties of the cigarette paper, such as ash, additives and combustibility, remain the same.

Furthermore, it has been found that the impregnation or coating of the cigarette paper by conventional processes and with suitable auxiliary binders, for example starch, carboxymethyl cellulose, alginates, as well as a pigment coating, does not impair the reduction of the carbon monoxide due to the increase in the diffusion which has been described. The concentrations of binders which are applied appropriately range from 1 to 20% by weight, whereas the pigment coatings should range from 4 to 35% by weight. These figures relate in each case to the total weight of the paper.

Embodiments of the present invention will now be described, by example only, with reference to several Examples of formulations of a cigarette paper, in which the proportion of CO in the smoke is reduced by improving the CO diffusion.

The following details of weight relate to the dry weight of the paper.

EXAMPLE A 22.7% by weight of bast fibres based on flax,
42.1% by weight of short fibres based on eucalyptus- and/or esparto pulp,
34.0% by weight of calcium carbonate and/or magnesium carbonate, and
1.2% by weight of burning additives The degree of grinding of the fibres was about 95 SR, whereas the fibre residue of the fibre fraction $R_{16}$ was about 40%. The cigarette paper which was produced according to this formulation has an air permeability of 25 $cm^3/min. cm^2. Kpa$.

EXAMPLE B 32.4% by weight of bast fibres based on flax,
32.4% by weight of short fibres based on esparto- and/or eucalyptus pulp,
34.0% by weight of calcium carbonate and/or magnesium carbonate, and
12.% by weight of burning additives.

The fibre residue and the degree of grinding were the same as the values stated for Example A. The cigarette paper produced according to this formulation had an air-permeability of 40 $cm^3/min. cm^2. kPa$.

EXAMPLE C 23.2% by weight of bast fibres based on cotton,
28.6% by weight of pine pulp and/or regenerated cellulose,
13.0% by weight of short fibres based on eucalyptus- and/or esparto pulp,
34.0% by weight of calcium carbonate and/or magnesium carbonate, and
1.2% by weight of burning additives.

The fibre residue and the degree of grinding were about the same as the values in Example A. The air permeability of the cigarette paper produced according to this formulation was 25 $cm^3/min. cm^2. kPa$.

EXAMPLE D 21.25% by weight of bast fibres based on flax,
21.25% by weight of base fibres based on cotton,
22.3% by weight of short fibres based esparto-and/or eucalyptus pulp,
34.0% by weight of calcium carbonate and/or magnesium carbonate, and
1.2% by weight of burning additives;

The fibre residue and the degree of grinding were about the same as the values stated for Example A. The air permeability of the cigarette paper produced according to this formulation was 100 $cm^3/min. cm^2. Kpa$.

EXAMPLE E

A cigarette paper, produced according to the formulation of Example B, was impregnated with a 4% carboxymethylcellulose solution.

EXAMPLE F

A cigarette paper, produced according to the formulation of Example B, was coated with a pigment dispersion having the following composition:
5% of sodium alginate,
7% of calcium and/or magnesium carbonate, and
0.1% of dispersing agent.

COMPARATIVE EXAMPLE (normal cigarette paper)

A normal cigarette paper based on the following formulation was used as a Comparative Example:
55% of hardwood and softwood pulp,
10% of bast fibres,
5% of short fibre pulp, and
30% of calcium carbonate.

Degree of grinding: from 80 to 90 SR.

The diffusion coefficients were determined for the cigarette papers according to formulations A amd C, by the process described in the article from "Int. J. Heat Mass Transfer", Volume 23, P. 127–134.

The results of the examinations of these cigarette papers and of the cigarette paper according to the Comparative Example are given in the following Table.

TABLE 1

| | Air Permeability in $cm^3/min \cdot cm^2 \cdot kPa$ | Diffusion coefficient in $10^{-3} \cdot cm^2 \cdot s^{-1}$ |
|---|---|---|
| Cigarette Paper A | 25 | 11.6 |
| Cigarette Paper C | 25 | 10.9 |
| Comparison | 24 | 8.6 |

It may be seen that the diffusion coefficient of the cigarette papers produced according to the formulation of the present invention is greater than the diffusion coefficient of the comparison sample by more than 20%, with the same air permeability, i.e. the diffusion of the gas molecules out of the cigarette is quite considerably higher in the case of the cigarette paper of the present invention compared to conventional cigarette paper.

This improvement in the diffusion coefficient was examined using the behaviour of a certain gas, namely carbon monoxide. For this purpose, cigarette papers according to the formulations corresponding to Examples B and D, as well as a comparative sample produced by the conventional formulation, were tested in accordance with the regulations for smoking cigarettes according to DIN 10240. The results are given in the following Table.

TABLE 2

| Cigarette Paper Used | Condensate quantity in mg | Co in vol. % | Co in ml | Reduction in ml | For comparison in % |
|---|---|---|---|---|---|
| Example B | 16.2 | 5.1 | 14.6 | 1.2 | 7.6 |
| Example D | 16.2 | 4.9 | 14.4 | 1.4 | 8.9 |
| Comparative Example | 16.4 | 5.5 | 15.8 | — | — |

It may be seen that the CO concentration and the CO total quantity in the main smoke is greatly reduced.

A panel of experts judged the smoke taste of the cigarettes produced from the cigarette papers according to the present invention. None of the experts mentioned any negative influences on the cigarette papers which were tested.

Similar results were obtained when cigarette papers according to the stated formulations were impregnated or coated corresponding to Examples E and F.

Thus, in conclusion, it may be stated that cigarette papers which are produced according to the stated formulations result in a reduction of the CO main smoke yield by up to 2.5 ml or 15%, with an otherwise unchanged cigarette construction and material provision as well as a pre-determined air permeability of the cigarette paper. Consequently it is possible, for example, to balance the carbon monoxide content in the main smoke, in spite of reducing the air permeability, compared to a conventional cigarette paper.

We claim:

1. A cigarette paper comprising:

(a) burning additives and fillers, (b) from 20 to 50% by weight of a fiber selected from the group consisting of flax fibers, hemp fibers, or a combination of flax and hemp fibers, based on the dry weight of the paper, said fibers having an extremely fine fibrillation and a grinding degree of at least 92 SR, and characterized in that the fiber length ratio of said fibers when tested by determining the fiber fraction $R_{16}$ is such that 35 to 45% of the tested fibers remain as a residue when sifted with a sieve having 16 meshes per 1 cm.

2. An article which may be smoked comprising:

a material suitable for smoking and a cigarette paper comprising:

(a) burning additives and fillers, (b) from 20 to 50% by weight of a fiber selected from the group consisting of flax fibers, hemp fibers, or a combination of flax and hemp fibers, based on the dry weight of the paper, said fibers having an extremely fine fibrillation and a grinding degree of at least 92 SR, and characterized in that the fiber length ratio of said fibers when tested by determining the fiber fraction $R_{16}$ is such that 35 to 45% of the tested fibers remain as a residue when sifted with a sieve having 16 meshes per 1 cm.

3. A cigarette paper according to claim 1, having an area weight of from 16 to 40 g/m$^2$.

4. A cigarette paper according to claim 1, having an area weight of from 20 to 30 g/m$^2$.

* * * * *